US005285492A

United States Patent [19]

Janouin et al.

[11] Patent Number: 5,285,492

[45] Date of Patent: Feb. 8, 1994

[54] SAFETY DEVICE IN A RADIOLOGY MACHINE

[75] Inventors: Serge Janouin, Moulineaux; Jacques Le Guen, Paris; Bernard Pouzergues, Villemoisson sur Orge, all of France

[73] Assignee: General Electric CGR S.A., Moulineaux, France

[21] Appl. No.: 921,105

[22] Filed: Jul. 30, 1992

[30] Foreign Application Priority Data

Jul. 31, 1991 [FR] France ..... 91 09764

[51] Int. Cl.[5] ..... H05G 1/04

[52] U.S. Cl. ..... 378/200; 378/141; 378/199

[58] Field of Search ..... 378/200, 199, 201, 202, 378/203, 141, 127, 130, 117

[56] References Cited

U.S. PATENT DOCUMENTS 2,290,322 7/1942 Goldfield .
4,780,901 10/1988 Gabbay et al. ..... 378/200
4,862,489 8/1989 Appelt .
4,995,065 2/1991 Janquin et al. .
5,008,916 4/1991 Le Guen .

FOREIGN PATENT DOCUMENTS 0283688 9/1988 European Pat. Off. .
0397562 11/1990 European Pat. Off. .
0259497 11/1986 Japan ..... 378/200
834719 5/1960 United Kingdom .

*Primary Examiner*—David P. Porta
*Attorney, Agent, or Firm*—Cushman, Darby & Cushman

[57] ABSTRACT

A safety device for an X-ray unit comprises an X-ray tube protected by a casing and cooled by a fluid circulating between the tube and the casing. This device is aimed at preventing any excess pressure of the cooling fluid in the casing. It comprises a rigid, hermetically sealed and vacuum-tight cavity connected to the circuit of the fluid by a hydraulic connector with a high flow rate, designed to open mechanically and automatically under the effect of the fluid, by a pressure that exceeds a predetermined threshold.

9 Claims, 3 Drawing Sheets

SAFETY DEVICE IN A RADIOLOGY MACHINE

BACKGROUND OF THE INVENTION

1. Field of the Invention

The invention relates to a safety device in a radiology machine and, more particularly, to a device for regulating the pressure of the cooling fluid of the X-ray tube in an X-ray unit.

An X-ray tube is constituted by a cathode and an anode enclosed in a vacuum-sealed jacket that enables electrical insulation to be set up between these two electrodes. The cathode is supplied with high voltage to produce an electron beam impinging onto the anode on a small surface which constitutes the focal spot of emission of the X-rays.

During its operation, the X-ray tube produces a large amount of heat, for only a small proportion of the energy used to produce the electron beam between the cathode and the anode is converted into X-rays, the rest being converted into heat. In an X-ray unit, to dissipate this heat, the X-ray tube is enclosed in a protection chamber or casing. Between the tube and the internal wall of the casing, there flows a cooling fluid which gets heated upon contact with the tube, before passing again into a circuit where it is itself cooled in a heat-exchanger, of the air or water type for example.

This fluid contained in the chamber is subjected to high rises in temperature, leading to an expansion of its volume, hence to a possibility of excess pressure inside the chamber when the tube works outside its normal range of operation. However, the pressure of the fluid cannot go beyond a limit threshold of about 4 bars, or else there will be deterioration of the X-ray unit.

2. Description of the Prior Art

There are two types of solutions envisaged, at present, to solve the problems of the accidental occurrence of excess pressure. These are, firstly, to permit a greater volume of expansion of the cooling fluid and, secondly, to monitor the pressure and the temperature of this fluid.

According to the first type of solution, the chamber that protects the X-ray tube is provided with an elastic membrane, permitting variations in the volume of expansion of the cooling fluid during the normal operation of the tube. However, during great increases in temperature, which give rise to increases in the volume of expansion of the fluid exceeding the limit permitted by the membrane, there arise either risks of the tearing of this membrane resulting in the release of the entire volume (namely about ten liters) of the hot fluid in the vicinity of the patient and the radiologist, or risks of the bursting of the tube, which would damage the X-ray unit, which may thus become dangerous.

Furthermore, the present trend is to reduce the dimensions of the X-ray unit to the maximum, preventing an increase in the volume of expansion. As for the choice of a rigid and closed chamber to place maximum limits on the splashing of liquid, this proves to be more dangerous in the event of a high degree of excess pressure of the fluid in the chamber.

In order to prevent such risks, the second type of solution provides for safety devices comprising pressure sensors or temperature sensors for the cooling fluid. However, owing to the continual development of X-ray tubes towards ever greater power values and, above all, towards ever greater thermal capacities for the anode, associated with a limitation of the space occupied by the X-ray unit, the risk of excess pressure of the fluid in the casing has considerably increased. Thus, in the case of a relatively lengthy X-ray examination during which the temperature of the cooling fluid is close to its upper limit value and the heat stored in the anode is at its maximum, any stopping of the cooling process, due to a current failure for example, will prompt a major increase in the temperature of the fluid which could be detrimental, even if the above-mentioned safety devices have worked perfectly. Indeed, since the anode is at its maximum temperature, it will release the heat stored by radiation towards the fluid which is no longer cooled. If, in addition, the X-ray tube breaks at this precise instant, the heat of the anode is instantly yielded to the fluid. It is observed then that all that the safety systems have done is to cut off the power supply of the X-ray tube: they have not prevented the risks of excess pressure of the fluid in the protective chamber.

SUMMARY OF THE INVENTION

The object of the present invention is to make a safety device that prevents any dangerous excess pressure of the cooling fluid of an X-ray tube in its protective casing, working automatically as soon as the fixed pressure threshold is exceeded and releasing only a small volume of fluid needed to make the pressure fall back below the maximum threshold chosen.

To this end, the safety device for an X-ray device, comprising an X-ray tube enclosed in a protective casing wherein there flows a cooling fluid, is constituted by a rigid, hermetically sealed, vacuum-tight cavity connected to the casing by a hydraulic connector with a high flow-rate, said cavity being designed to open mechanically and automatically under the effect of the fluid, for a fluid pressure that is above a fixed pressure threshold.

BRIEF DESCRIPTION OF THE DRAWINGS

Other objects, advantages and features of the invention shall appear from the following description of exemplary embodiments, illustrated by the appended drawings, of which.

The elements bearing the same reference elements in the different figures fulfil the same functions in view of giving the same results.

DETAILED DESCRIPTION OF THE INVENTION

Figure 1:
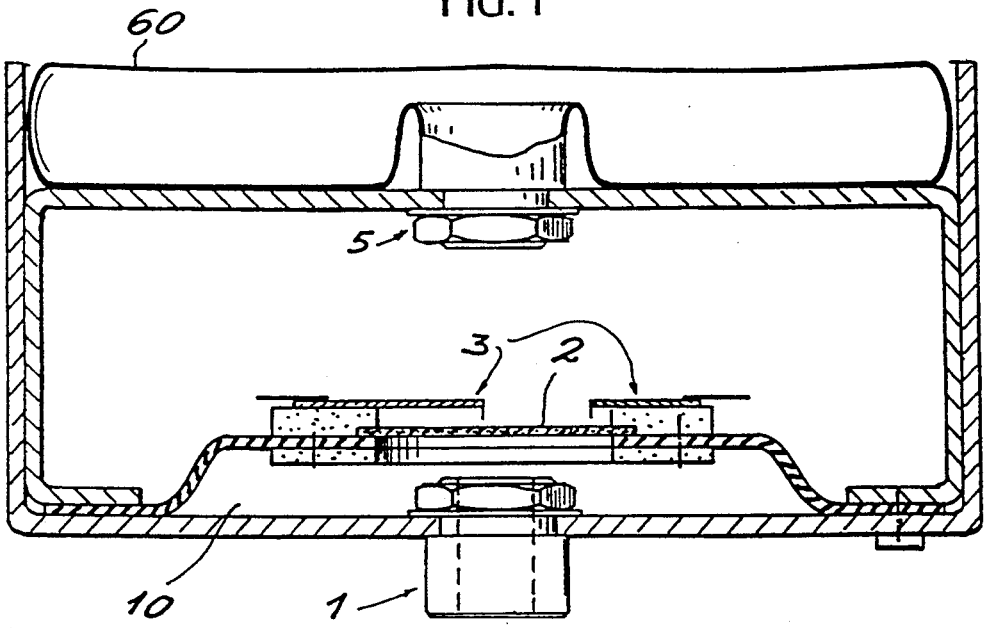
FIG. 1 shows a cross-sectional view of a first exemplary embodiment of a safety device according to the invention.

The first exemplary embodiment of the safety device according to the invention, shown in a cross-sectional view in FIG. 1, comprises a cavity 10, cylindrical for example, rigid and hermetically sealed, perfectly vacuum-tight, designed firstly for the filling, in vacuo, of the X-ray unit with the cooling fluid and, secondly, for the efficient operation of the protective casing.

This cavity 10 is connected to the circuit of the cooling fluid, i.e. either to the casing or to the pipes of the circuit, by a hydraulic connector 1 with a high flow-rate. Inside the cavity 10, facing this connector 1, there is positioned a carbon sheet 2 with a calibrated thickness. This carbon sheet 2 provides for vacuum tightness during the normal operation of the X-ray tube, but breaks for a determined value of excess pressure of the cooling fluid (between 2 and 4 bars for example), thus enabling the fluid to fill the cavity 10 almost instantaneously. This cavity may be under low pressure initially. In addition, an electrical contact 3 is positioned between an indicator external to the apparatus and the carbon sheet 2, electrically closed by said carbon sheet 2, thus indicating the working of the safety device.

To obtain a major expansion of volume in the event of excess pressure of the cooling fluid, without using a cavity 10 that has an excessively great volume, it is possible to provide for an elastic cavity 60, external to the rigid cavity 10 and connected to it by a valve 5, adjusted so as to open under a low pressure (0.5 bar for example) permitting a volume additional to the volume of the cavity 10 which receives the shock wave. This additional elastic cavity 60 may be an inflatable rubber bladder.

In a practical exemplary embodiment, the Applicant has built a safety device with a carbon plate 2 having a diameter of 100 millimeters, enabling precision of +15% with respect to the breaking pressure of the sheet.

This approach comprising the elastic cavity 60 has the advantage, firstly, of offering an additional volume of expansion without taking up space, during the normal working of the X-ray tube, and without increasing the weight of the radiology apparatus, and then of enabling the operation of the safety device to be displayed.

Figure 2:
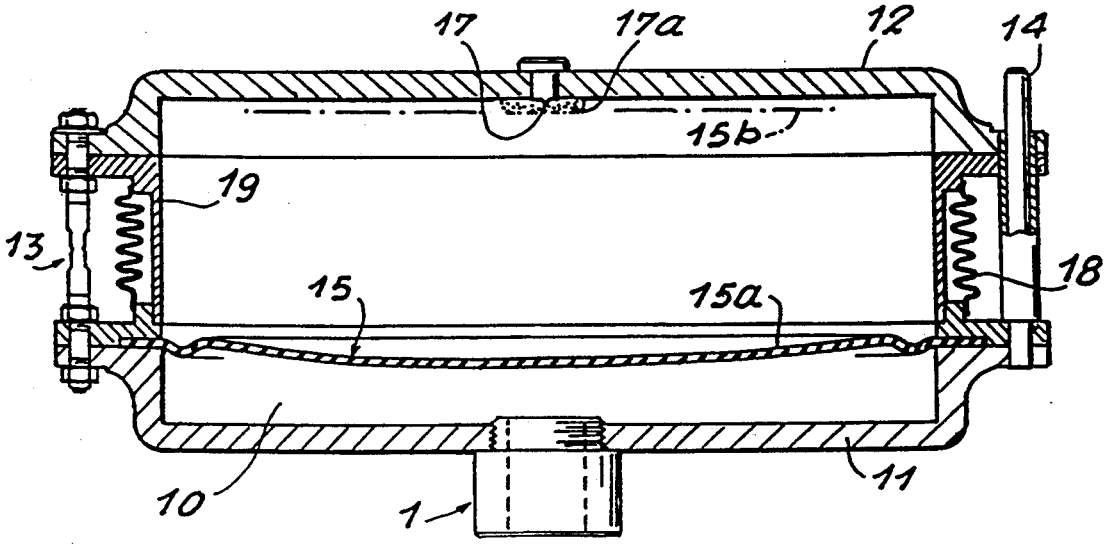
FIG. 2 shows a cross-sectional view of a second exemplary embodiment of a safety device according to the invention.

The second exemplary embodiment of the safety device, shown in a cross-sectional view in FIG. 2, solves two problems proper to the X-ray unit, a first one being that of the normal expansion of the volume of the fluid in the protective casing of the X-ray tube without any increase in the dimensions of this tube and a second one being that of obtaining safety in the event of excess pressure of the fluid beyond the predetermined limits.

The device comprises a rigid cavity 10, which is cylindrical for example, formed by two parts 11 and 12 that are hermetically connected by a tightly sealed metal expansion member or bellows 18 and by a protective spacer 19 parallel to the bellows, placed inside the cavity. The two parts 11 and 12 are furthermore held so as to be fixedly joined together by rods 13, called breaking rods, and rods 14, called guiding rods, placed outside the bellows 18, these rods 13 and 14 being arranged alternately.

The breaking rods 13 are calibrated for a given breaking pressure (2 to 4 bars) exerted on the internal face of the cavity, within the fixed pressure threshold $P_S$.

The part 11 is connected to the circuit of the cooling fluid (to the casing for example), by a hydraulic connector 1 with a high flow rate. Inside the cavity 10, an impervious and elastic membrane 15 (made of rubber for example) is fixed along its periphery. This membrane 15 can shift between two extreme positions 15a and 15b.

During the normal working of the X-ray tube, the cooling fluid expands in the cavity 10 between these two extreme positions of the membrane 15. When the pressure of the fluid goes beyond the fixed pressure threshold $P_S$ permitted by the extreme position 15b of the membrane 15, the membrane tears and, simultaneously, the breaking rods 13 are broken and the bellows 18 stretches out so as to instantaneously enlarge the volume of the cavity 10, filled with the fluid. However, the guiding rods 14 have held the parts 11 and 12 parallel to each other.

Figure 3:
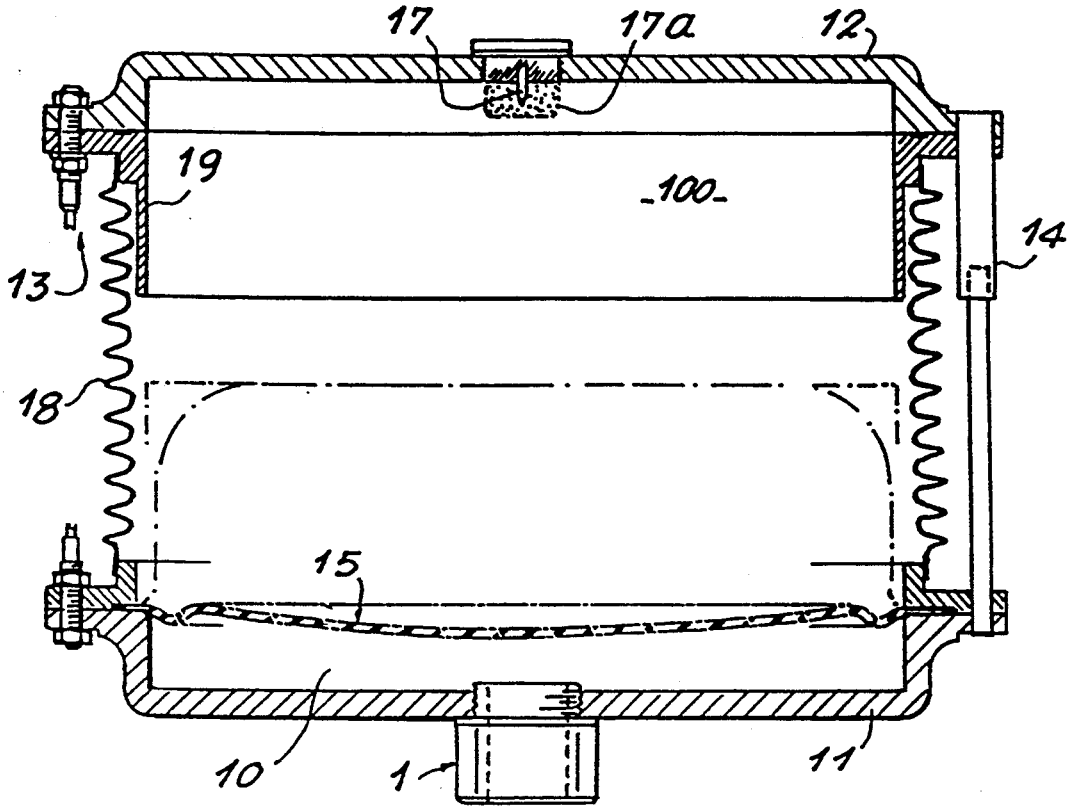
FIG. 3 shows a cross-sectional view of a second exemplary embodiment of a safety device, after the safety device has been triggered.

FIG. 3 is a view similar to that of FIG. 2, but after the triggering of the safety device under the effect of an excess pressure of the cooling fluid above the permitted threshold PS. The initial volume of the cavity 10 has increased by an additional volume 100, which makes the triggering of this safety system visible to the user of the radiology instrument.

To facilitate the tearing of the membrane 15 in the event of excess pressure, it is possible to add a cutting tip or head 17 to the internal face of the part 12 of the cavity 10, as shown in FIGS. 2 and 3.

This cutting head 17 may be shielded by foam 17a, in order to prevent an accidental tearing of the membrane 15 during a normal expansion of the cooling fluid that would bring this membrane to the extreme position 15b. It is only in the event of excess pressure of the fluid, when the membrane 15 gets crushed against the internal wall of the cavity 10, that the foam 17a gets crushed, revealing the cutting head 17.

Figure 4:
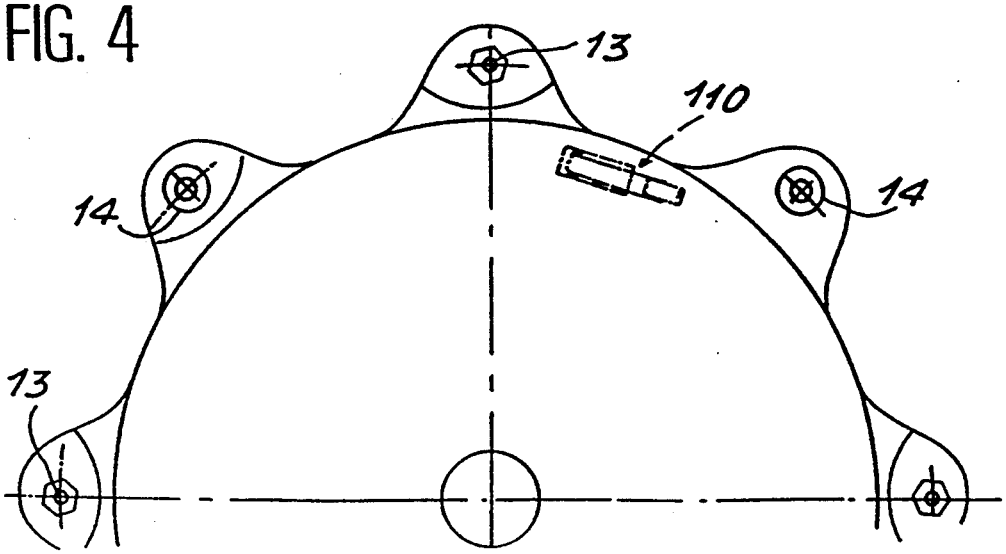
FIG. 4 shows a top view of a second exemplary embodiment of the invention.

FIG. 4 shows a top view of the safety device, according to the second exemplary embodiment, showing the alternating arrangement of guiding rods 14 and breaking rods 13.

Figure 5:
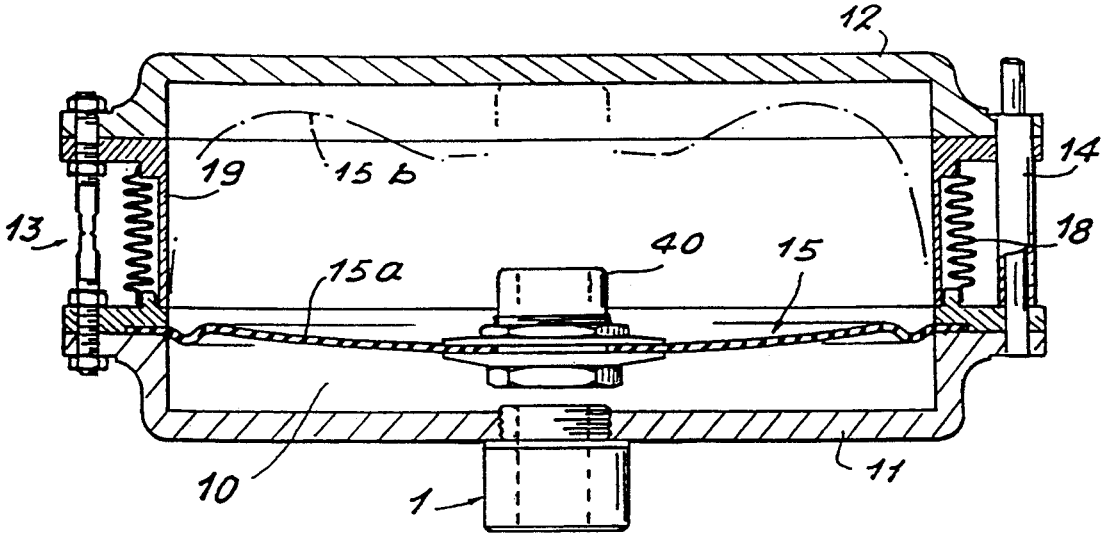
FIGS. 5 and 6 are cross-sectional views of two other variants of the second exemplary embodiment of the device according to the invention.

One variant of this second exemplary embodiment of the safety device according to the invention is shown in FIG. 5 which is a view in cross-section. The membrane 15 is fitted out with a pressure relief valve 40 having a high flow-rate, as a replacement for the approach in which this membrane 15 is torn by the cutting head 17.

Figure 6:
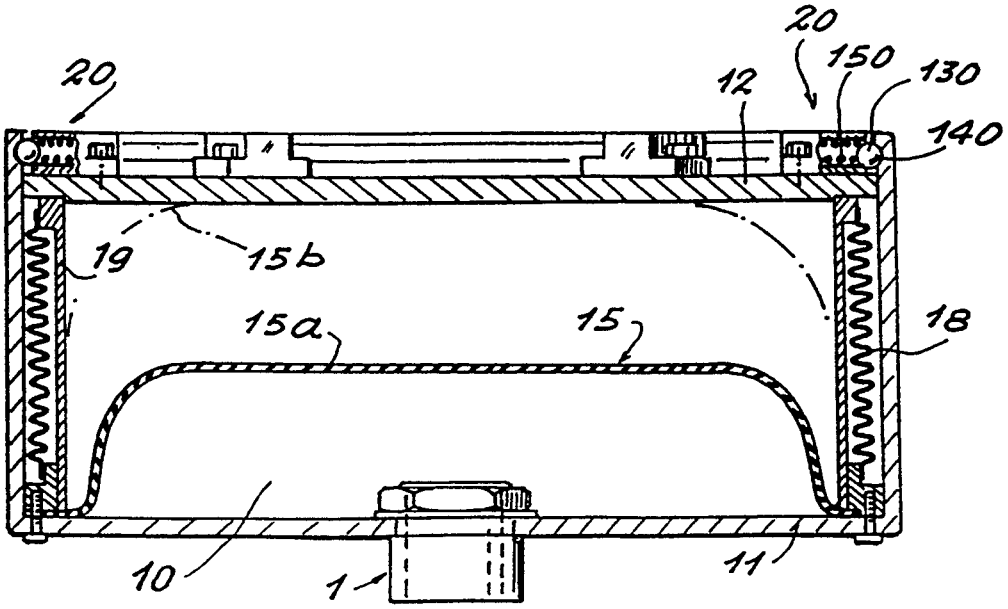

According to another variant of this second exemplary embodiment shown in FIG. 6, the device for the fixing of the two parts 11 and 12 of the cavity 10 to each other is constituted by at least three ball systems 20 placed on the external face of the part 12. The ball 130 of each system is held by a spring 150 in a groove 140 made in the part 11. The calibration of this spring 150 is such that, for an excess pressure of fluid in the cavity 10, the ball emerges from its groove and releases the expansion of the metal bellows 18.

A practical example has been made by the Applicant, for an X-ray unit working with ten liters of cooling fluid, with a cylindrical cavity having an internal diameter of 160 millimeters, an external diameter of 200 millimeters and a total height of 70 millimeters: it permits a normal volume of expansion of 1.3 liters for the fluid and, in the event of excess pressure, it offers an additional volume of 4.5 liters for a bellows height of 300 millimeters. Values such as these are highly suitable for an application in a radiology machine.

An electrical contact 110 (FIG. 4) may be added, connecting the two parts 11 and 12 of the cavity 10, whatever may be the variant of the embodiment. This electrical contact will be designed to report the operation of the safety device to an external indicator, in the event of excess pressure of the fluid.

The safety device for an X-ray unit that has just been described has the advantage of getting triggered automatically as soon as the pressure threshold $P_S$, which is set to prevent any damage to the tube, is crossed without its being possible to neutralize it externally and without its operation being blocked by a current failure for example. Since it can be either placed on the protective casing of the tube or connected to the pipes of the cooling fluid circuit, this device can easily be adapted to any radiology apparatus without increasing significantly either its dimensions or its total weight.

What is claimed is:

1. A safety device for an x-ray unit comprising:

an x-ray tube enclosed in a protective casing and cooled by a fluid coming from a cooling circuit and flowing between the tube and the internal wall of the casing;

said safety device being constituted by a rigid, hermetically sealed, vacuum-tight cavity connected to the cooling fluid circuit by a hydraulic connector with a high flow-rate; and said cavity being openable mechanically and automatically under the effect of the fluid, by a fluid pressure that is above a predetermined pressure threshold;

wherein said cavity comprises a carbon sheet disposed inside said cavity facing said hydraulic connector to provide for the vacuum tightness of the cavity during the normal operation of the x-ray unit, the thickness of said carbon sheet being calibrated so that it is broken when the pressure of the cooling fluid is higher than the predetermined pressure threshold.

2. A device according to claim 1, wherein an additional elastic and vacuum-tight cavity is connected to said cavity by a valve that is adjusted to open during a slight excess pressure of the fluid.

3. A safety device for an x-ray unit comprising:

an x-ray tube enclosed in a protective casing and cooled by a fluid coming from a cooling circuit and flowing between the tube and the internal wall of the casing;

said safety device being constituted by a rigid, hermetically sealed, vacuum-tight cavity connected to the cooling fluid circuit by a hydraulic connector with a high flow-rate; and said cavity being openable mechanically and automatically under the effect of the fluid, by a fluid pressure that is above a predetermined pressure threshold; (according to claim 1,)

wherein said rigid, hermetically sealed and vacuum-tight cavity is formed by:

two parts that are hermetically connected by a tightly sealed metal bellows and by a protective spacer placed parallel to said bellows inside said cavity, the two parts being held so as to be fixedly joined by means of a fixing device placed outside said bellows;

an impervious and elastic membrane that is fixed to the interior of said cavity by its periphery and is capable of shifting therein between two extreme positions, and wherein, when the pressure of the cooling fluid goes beyond said predetermined pressure threshold in the casing, said membrane tears and said fixing device breaks, releasing the extending motion of the bellows (blower) to increase the volume of the cavity.

4. A device according to claim 3, wherein said device for fixing the two parts of said cavity comprises guiding rods and breaking rods placed alternately around said cavity.

5. A device according to claim 3, wherein said device for fixing the two parts of said cavity comprising at least three ball systems, each ball of which is held in a groove, made in one of the parts of said cavity, by a spring, the calibration of which is such that the ball emerges from its groove and releases the expansion motion of the metal bellows for a pressure of the fluid that is above said predetermined pressure threshold.

6. A device according to claim 3, wherein the internal face of one of the parts of said cavity is provided with a cutting head, used to tear said membrane, said cutting head being shielded by foam.

7. A device according to claim 6, wherein said cutting head is shielded by a layer of foam.

8. A device according to claim 3, wherein said membrane is fitted out with a pressure relief valve having a high flow-rate.

9. A device according to claim 3, further comprising an electrical contact connecting the two parts of said cavity and connected to an indicator external to the X-ray unit, designed to report the operation of the safety device when the pressure of the fluid goes beyond the predetermined pressure threshold.

* * * * *

UNITED STATES PATENT AND TRADEMARK OFFICE

CERTIFICATE OF CORRECTION

PATENT NO. : 5,285,492

DATED : February 8, 1994

INVENTOR(S) : JANOUIN ET AL

It is certified that error appears in the above-indentified patent and that said Letters Patent is hereby corrected as shown below:

Delete in Column 6 line 17 "(blower)"

Signed and Sealed this

Fifteenth Day of November, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,285,492
DATED : February 8, 1994
INVENTOR(S) : JANOUIN ET AL

It is certified that error appears in the above-indentified patent and that said Letters Patent is hereby corrected as shown below:

IN THE CLAIMS

Delete in Column 5 last line "(according to claim 1,)"

Signed and Sealed this

Twenty-first Day of February, 1995

*Attest:*

Bruce Lehman

BRUCE LEHMAN

*Attesting Officer*

*Commissioner of Patents and Trademarks*